US006672430B2

(12) United States Patent
Boucher et al.

(10) Patent No.: US 6,672,430 B2
(45) Date of Patent: Jan. 6, 2004

(54) DEVICE AND METHOD FOR ADJUSTING A FORCE APPLIED TO A MOVABLE ELEMENT

(75) Inventors: Ronald Henry Boucher, Goffstown, NH (US); Raymond Alphonse Hebert, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/901,255

(22) Filed: Jul. 9, 2001

(65) Prior Publication Data

US 2003/0006099 A1 Jan. 9, 2003

(51) Int. Cl.[7] ..... A47B 9/16; B66B 9/02

(52) U.S. Cl. ..... 187/269; 187/211; 108/145; 182/141

(58) Field of Search ..... 187/269, 211; 254/9 C, 10 C, 122, 124; 182/63, 141; 108/147, 136, 144, 145; 248/421, 588

(56) References Cited

U.S. PATENT DOCUMENTS

| | | | | | |
|---|---|---|---|---|---|
| 2,829,863 | A | * | 4/1958 | Gibson | 254/8 C |
| 2,937,852 | A | * | 5/1960 | Clarke | 254/122 |
| 3,110,476 | A | * | 11/1963 | Farris | 182/141 |
| 3,282,566 | A | * | 11/1966 | Clarke | 187/269 |
| 3,404,791 | A | * | 10/1968 | Larson | 254/122 |
| 4,157,743 | A | * | 6/1979 | Masuda et al. | 187/269 |
| 4,526,346 | A | * | 7/1985 | Galloway et al. | 187/269 |
| 4,558,648 | A | | 12/1985 | Franklin et al. | 108/147 |
| 4,712,653 | A | | 12/1987 | Franklin et al. | 187/269 |
| 4,741,512 | A | * | 5/1988 | Elkuch et al. | 254/122 |
| 4,979,592 | A | * | 12/1990 | Isogai | 187/269 |
| 5,695,173 | A | * | 12/1997 | Ochoa et al. | 254/122 |
| 5,722,513 | A | * | 3/1998 | Rowan et al. | 187/269 |
| 6,516,478 | B2 | * | 2/2003 | Cook et al. | 187/269 |

FOREIGN PATENT DOCUMENTS

JP 11060174 3/1999

* cited by examiner

*Primary Examiner*—Dean J. Kramer
*Assistant Examiner*—Paul T. Chin
(74) *Attorney, Agent, or Firm*—Davidson, Davidson & Kappel, LLC

(57) ABSTRACT

A method for adjusting a first force applied to a movable element in a first position of the movable element by a force applying device, the force applying device applying a second force to the movable element in a second position of the movable element. The method includes connecting the movable element and a base element with a scissors-type linkage; mounting the force applying device to the scissors-type linkage at a first mounting point; mounting the force applying device to the base element at a second mounting point; and moving at least one of the first and the second mounting points along a constant force curve, so that the second force remains constant as the first force is adjusted. A device for adjusting a first force applied to a movable element in a first position is also provided.

18 Claims, 8 Drawing Sheets

DEVICE AND METHOD FOR ADJUSTING A FORCE APPLIED TO A MOVABLE ELEMENT

BACKGROUND OF THE INVENTION

The present invention relates generally to a device and method for adjusting a force applied to a movable element such as a platform.

Scissors-type linkages are used in many devices and machines for providing movable characteristics, e.g. in lifting devices such as liftable platforms. The scissors-type linkage allows for lifting a platform into an upper, open or extended position starting from a lower, close or retracted position in which the platform can come very close to a base or the floor or can even contact one of those.

A movable element such as a liftable platform which is connected, e.g. to a base, a floor, an operation deck or the frame of a machine such as a printing machine, can be moved, e.g. raised, by the operator himself, by a driving device such as a motor or by the assistance of an energy-recycling mechanism or device.

The force which is applied to the movable element has to be adjusted based on the weight of the movable element, the weight of the scissors-type linkage and perhaps on the weight of a load or an operator in the case where the scissors-type linkage is used to lift or hold goods or operators. If no additional loads are present, the force only has to compensate or exceed the gravitational and frictional forces of the mechanism itself.

It is advantageous to use an energy-recycling device such as a gas spring for moving or raising the element. The energy which becomes free when the element is moved in its lower position can then be stored in the energy-recycling device, e.g. in the compression of a gas in the gas spring, and can be used to assist the movement into the upper position.

U.S. Pat. No. 4,712,653, which is incorporated by reference herein, discloses an energy-recycling scissors lift including a platform, a base and a pair of scissors linkages, each having a pair of first and second scissors legs. A bridge structure connects each of the second legs together. A sealed gas cylinder, attached to the base and the bridge structure, moves the platform to an extended position above the base. Energy is stored in the sealed gas cylinder as the platform descends to a retracted position and a compensation device is attached to the scissors lift to compensate for the overforce caused by the sealed gas cylinder.

A weight adjustment mechanism is used which includes means for adjusting the forcing-point radius, i.e the radius of the mounting point of the sealed air cylinder to the bridge structure with regard to the mounting point of the scissors legs at the base, to compensate for and dissipate an amount of overforce imparted by the sealed gas cylinder. Therefore, the weight adjustment mechanism can be used to fine tune a sufficient force that maintains the platform in its extended position, resulting in a scissors lift which can be easily started down to its retracted position. The weight adjustment mechanism can also adjust the upward force needed to start the platform towards its extended position.

The above-referenced patent has the disadvantage that the force applied to the platform in its retracted position can not be adjusted independently from the force applied to the platform in its extended position and vice versa.

FIG. 1 shows a prior art device 1 for lifting a platform 2. The device 1 comprises a scissors-type linkage 4, which includes a first scissors leg 6 and a second scissors leg 8 which are connected at a pivot point 10. A second pair of scissors legs in addition connects the platform 2 and a base 16 but it is not shown for purposes of clarity. FIG. 1 shows the scissors-type linkage 4 in a closed position or closed mode. The first scissors leg 6 is mounted with one end to the platform 2 at a mounting point 12 whereas the other end is movingly supported by a roll 14. The second scissors leg 8 is mounted with one end to the base 16 at a mounting point 18 whereas the other end is movingly supported by a roll 20. The device 1 further comprises a gas spring 22 having a cylinder 24 and a piston rod 26. The gas spring 22 is mounted with one end to the scissor type linkage 4 at a first mounting point 28 and with the other end at a second mounting point 30 to a mounting plate 32 of the base 16.

The gas spring 22 applies a force 34 to the platform 2 which assists the lifting of the platform 2. If an operator grips the platform at a handle 36 and pulls or pushes the platform up, he only has to apply an additional force to the platform so that the sum of the force applied by the gas spring 22 and the force applied by himself exceeds the gravitational force on the platform 2 and lifting device 1.

FIG. 2 shows the prior art device 1 for lifting the platform 2, in which the platform 2 is in an upper position and the scissors-type linkage 4 is in an open position or open mode. The gas spring 22 applies a force 134 to the platform 2 which maintains the platform 2 in the upper position, i.e. the force 134 must be equal to or can be greater than the gravitational force on the platform and the lifting device 1. Advantageously the force 134 exceeds the gravitational force only minimal.

As can be seen from FIGS. 1 and 2 the second mounting point 30 of the gas spring 22 does not move because it is fixed at the mounting plate 32 of the base 16. Therefore, the force 134 is smaller than the force 34 as indicated by the respective length of the arrows 34 and 134. The force applied to the scissors-type linkage 4 and subsequently to the platform 2 by the gas spring 22 depends on the angle between the piston rod 26 and the first scissors leg 6 and it depends on the compression of the gas spring.

Both positions of the platform 2, the upper shown in FIG. 2 and the lower position shown in FIG. 1, can be fixed by the use of a fixing element such as a pin.

BRIEF SUMMARY OF THE INVENTION

An object of the present invention is to provide a method and device for adjusting a first force applied to a movable element in a first position so that a second force applied to the movable element remains constant.

It is a further alternate or additional object of the present invention to provide a method and device for independently adjusting a first and a second force applied to a movable element such as a platform.

The terms "first force", "second force", "third force" and "fourth force" in this application are used herein solely to distinguish the forces from one another, and are not meant to have any other specific meaning.

The present invention provides a method for adjusting a first force applied to a movable element in a first position of the movable element by a force applying device, the force applying device applying a second force to the movable element in a second position of the movable element, comprising the steps of:

connecting the movable element and a base element with a scissors-type linkage;

mounting the force applying device to the scissors-type linkage at a first mounting point;

mounting the force applying device to the base element at a second mounting point;

moving at least one of the first and the second mounting points along a constant force curve, so that the second force remains constant as the first force is adjusted.

The terms "first mounting point", "second mounting point", "third mounting point" and "fourth mounting point" in this application are used herein solely to distinguish the mounting point from one another, and are not meant to have any other specific meaning.

The method according to the invention advantageously allows for compensating for force applying device wear or deviations in strength as it is supplied by the manufacturer, e.g. gas spring wear or deviation. Further, the method according to the invention allows the operators to easily adjust the required force, e.g. a lifting force, to their own liking, preference or need.

According to the invention the method may further comprise the steps of:

providing a further force applying device, the further force applying device applying a third force to the movable element in the first position of the movable element and the further force applying device applying a fourth force to the movable element in the second position of the movable element;

mounting the further force applying device to the scissors-type linkage at a third mounting point;

mounting the further force applying device to the base element at a fourth mounting point; and adjusting the fourth force applied to a movable element in the second position of the movable element by moving at least one of the third and the fourth mounting points along a constant force curve, so that the third force remains constant as the fourth force is adjusted.

Further the moving of at least one of the first, the second, the third and the fourth mounting point may be along an approximated constant force curve.

In another embodiment of the invention a method for independently adjusting a first and a fourth force applied to a platform comprises the steps of:

connecting the platform and a base element with a scissors-type linkage;

mounting a first gas spring to the scissors-type linkage at a first mounting point and mounting the first gas spring to the base element at a second mounting point;

mounting a second gas spring to the scissors-type linkage at a third mounting point and mounting the second gas spring to the base element at a fourth mounting point;

applying the first force to the platform in an upper position and applying a second force to the platform in a lower position using the first gas spring;

applying a third force to the platform in the upper position and applying the fourth force to the platform in the lower position using the second gas spring;

moving at least one of the first and the second mounting points along a constant force curve, so that the second force remains constant as the first force is adjusted; and moving at least one of the third and the fourth mounting points along a constant force curve, so that the third force remains constant as the fourth force is adjusted.

The present invention also provides a device for adjusting a first force applied to a movable element, comprising:

a movable element;

a base element;

a scissors-type linkage, the scissors-type linkage connecting the base element and the movable element; and a force applying device applying the first force to the movable element in a first position of the movable element and applying a second force to the movable element in a second position of the movable element;

the force applying device being mounted to the scissors-type linkage at a first mounting point and being mounted to the base element at a second mounting point, at least one of the first and second mounting points being movable along a constant force curve, so that the second force remains constant as the first force is adjusted.

The device according to the invention can be advantageously used to assist the movement of the movable element, e.g. a liftable platform, which movement can be done by hand by an operator. If the platform is moved into an upper position, the operator can climb up onto it or the platform can be used to lift loads or operators.

According to the invention the movable element may be platform, the first position may be an upper position and the second position may be a lower position.

Further, according to the invention the platform may be a liftable working platform of a printing press and the base element may be part of an operation deck of the printing press.

In another embodiment of the present invention the scissors-type linkage may include at least two pairs of scissors legs, each scissors leg being connect at one end to one of the platform and the base element.

The force applying device may be one of a gas spring, a coil spring, an air cylinder, a pneumatic cylinder or a hydraulic cylinder.

A device according to the invention may further comprise means for moving one of the first and second mounting points along the constant force curve. This means for moving one of the first and second mounting points may include a mounting element movable along a curved slot.

According to the invention the curved slot may approximate the constant second force curve or may be a straight slot.

In a further embodiment of the invention the second mounting point may include a mounting plate pivotally mounted to the base element and having a slot with two ends for receiving a pin, the two ends and the pin limiting the pivotal movement of the mounting plate and the force applying device may be pivotally mounted to the mounting plate.

The present invention further provides a device for adjusting a first force applied to a movable platform of a printing press, comprising:

a base element being part of an operation deck of the printing press;

a scissors-type linkage, the scissors-type linkage connecting the base element and the movable platform, the scissors-type linkage including at least two pairs of scissors legs; and a gas spring applying the first force to the movable platform in an upper position of the movable platform and applying a second force to the movable platform in a lower position of the movable platform;

the gas spring being mounted to the scissors-type linkage at a first mounting point and being mounted to the base element at a second mounting point, the second mounting point being movable along a constant force curve, so that the second force remains constant as the first force is adjusted.

The device according to the invention may also comprise a further force applying device, the further force applying device applying a third force to the movable element in the first position of the movable element and the further force applying device applying a fourth force to the movable element in the second position of the movable element, the further force applying device being mounted to the scissors-type linkage at a third mounting point and being mounted to the base element at a fourth mounting point. At least one of the third and fourth mounting points may be movable along a constant force curve, so that the third force remains constant as the fourth force is adjusted.

BRIEF DESCRIPTION OF THE DRAWINGS

A preferred embodiment of the present invention is described below by reference to the following drawings, in which.

DETAILED DESCRIPTION

Figure 1:
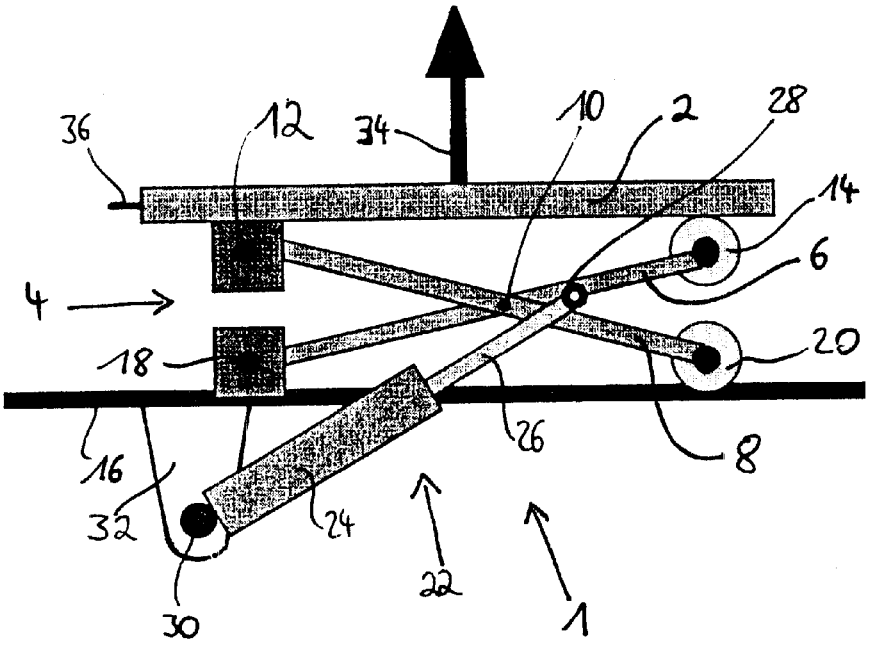
Fig. 1 PRIOR ART
FIG. 1 shows a schematic side view of a prior art device for lifting a platform, in which the platform is in a lower position.
Figure 2:
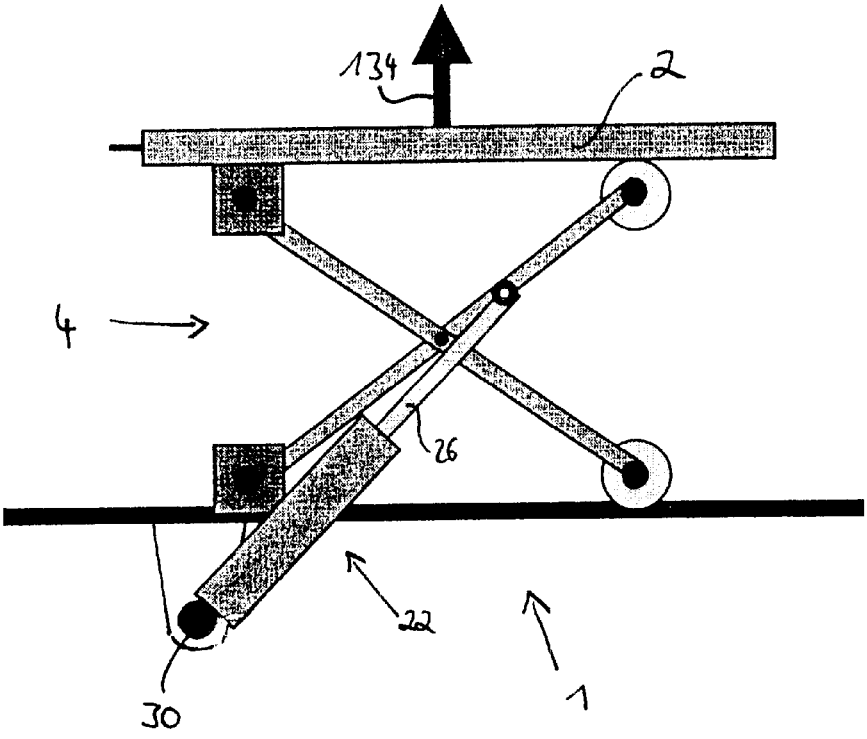
Fig. 2 PRIOR ART
FIG. 2 shows a schematic side view of a prior art device for lifting a platform, in which the platform is in an upper position.
Figure 3:
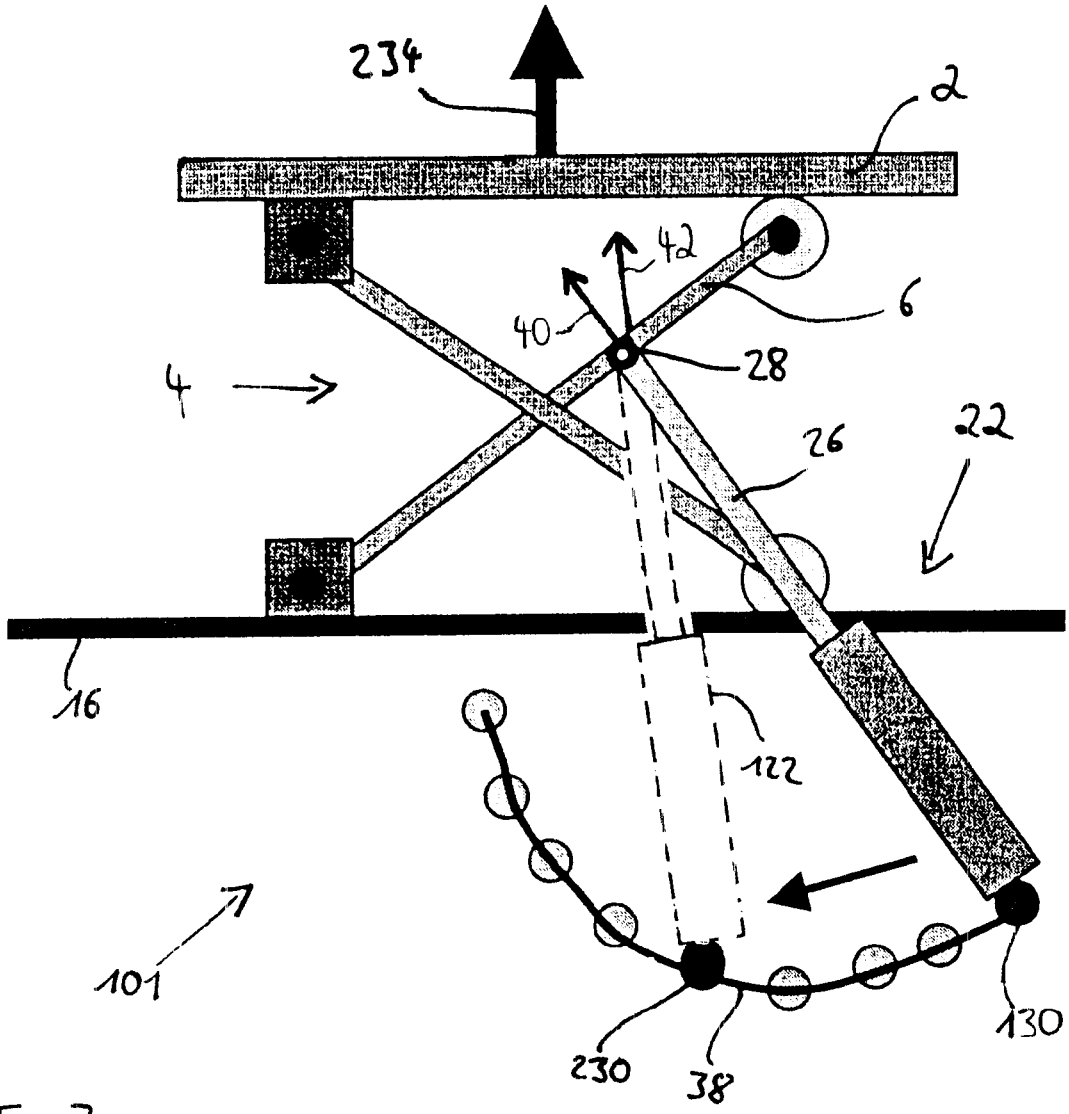
FIG. 3 shows a schematic side view of the device for adjusting a force applied to a platform according to the present invention, in which the mounting point of a gas spring is movable along a constant force curve.

FIG. 3 shows a device 101 according to the present invention for adjusting a force applied to the platform 2 in its lower position such as force 34 shown in FIG. 1. The device 101 comprises a scissors-type linkage 4 such as the one in FIGS. 1 and 2 which connects the platform 2 and a base 16 which is part of an operation deck of a printing press or a folder. As can be seen from FIG. 3 the first mounting point 28 of the gas spring 22 is fixed whereas the second mounting point 130 can be moved along a curve 38. Along the curve 38 several optional positions for the mounting point are shown which does not mean that only a discrete number of mounting points can be realized. It is also possible to move the second mounting point 130 continuously and thereby realize a continuous sequence of mounting points. For example, the second mounting point 130 can be moved along the curve 38 to position 230 so that the gas spring 22 is located in position 122 as indicated by the dashed line gas spring.

The shape of curve 38 can be achieved as follows: The second mounting point 130 is located so that the piston rod 26 is perpendicular to the first scissors leg 6 and that the force 40 applied to the first scissors leg 6 does only have a perpendicular component with respect to the first scissors leg 6. The compression of the gas spring 22 is preset so that a predetermined resulting force 234 is applied to the platform 2 as indicated by arrow 234. Then the first mounting point is moved to position 230 which is characterized by the same resulting force applied to the platform as indicate by arrow 234. The gas spring 22 in position 122 applies a force 42 to the first scissors leg 6 which results in the force 234 applied to the platform 2. All positions of the first mounting point 130 along the curve 38, e.g. position 230, result in the same force 234 applied to the platform 2. This is because the angle between the piston rod 26 and the first scissor leg 6 and the compression of the gas spring 22 change simultaneously. The curve 38 therefore is a constant force curve, i.e. the force 234 applied to the platform 2 remains constant as the mounting point 130 is moved along the curve 38. The shape of the curve 38 can be calculated using e.g. a computer and software or can be achieved from experiments.

Whereas the force 234 applied to the platform 2 in its upper position remains constant, the movement of the second mounting point 130 along curve 38 changes the force applied to the platform 2 as if it were in its lower position (similar to that as force 34). Therefore the constant force curve 38 can be used to adjust the force applied to the platform 2 in its lower position independently from the force 234 applied to the platform 2 in its upper position.

Figure 4:
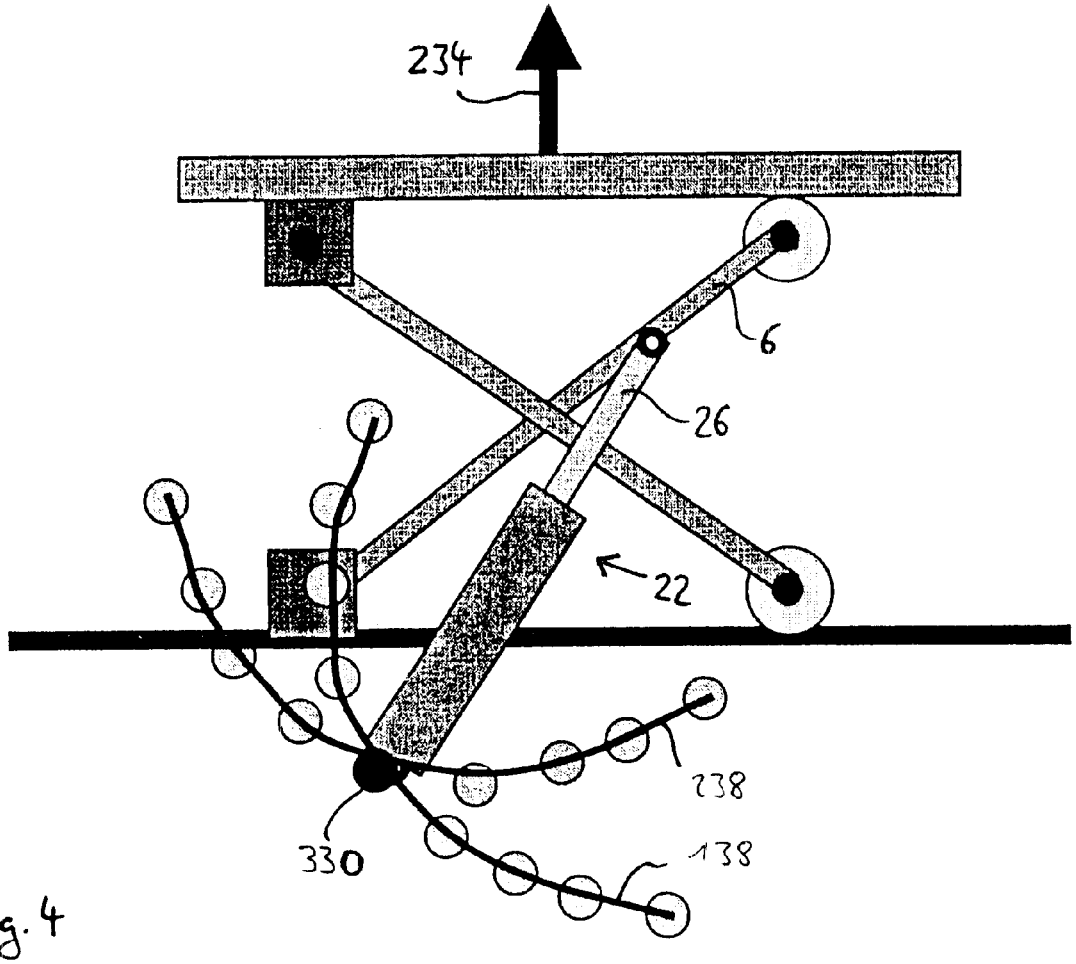
FIG. 4 shows a schematic side view of the device of FIG. 3, in which the mounting point of the gas spring is movable along a one of two constant force curves.

Referring to FIG. 4, the second mounting point of the gas spring 22 is moved to and located in a position 330 which is the cross point of a first constant force curve 138 and a second constant force curve 238. The first constant force curve 138 is achieved like the constant force curve 38 in FIG. 3 whereas the second constant force curve 238 is achieved vice versa, i.e. starting with the gas spring 22 located perpendicular to the first scissors leg 6 in the closed position of the scissors-type linkage 4. This position corresponds to the lower position of the platform 2. The compression of the gas spring 22 is then preset to achieve a predetermined force similar to 34 in FIG. 1 and the second mounting point of the gas spring 22 is moved so that, in dependence of the angle between the piston rod 26 and the first scissors leg 6 in its closed position and the compression of the gas spring 22 the resulting force applied to the platform 2 in its lower position remains constant. The cross point 330 of the two constant force curves 138 and 238 defines the required second mounting point for the gas spring 22 to achieve the predetermined upper force 234 and the predetermined lower force (similar to force 34) applied to the platform in its upper and lower position.

The force 234 applied to the platform 2 shown in FIG. 4 in its upper position can be adjusted independently from the force applied to the platform in its lower position by moving the second mounting point of the gas spring 22 along constant force curve 238 and vice versa, i.e. the force 34 applied to the platform 2 in its lower position can be adjusted independently from the force 234 applied to the platform in its upper position by moving the second mounting point of the gas spring 22 along constant force curve 138.

The second mounting point 130 of the gas spring 22 is mounted to the base 16 or the mounting plate 32 of the base 16.

Figure 5:
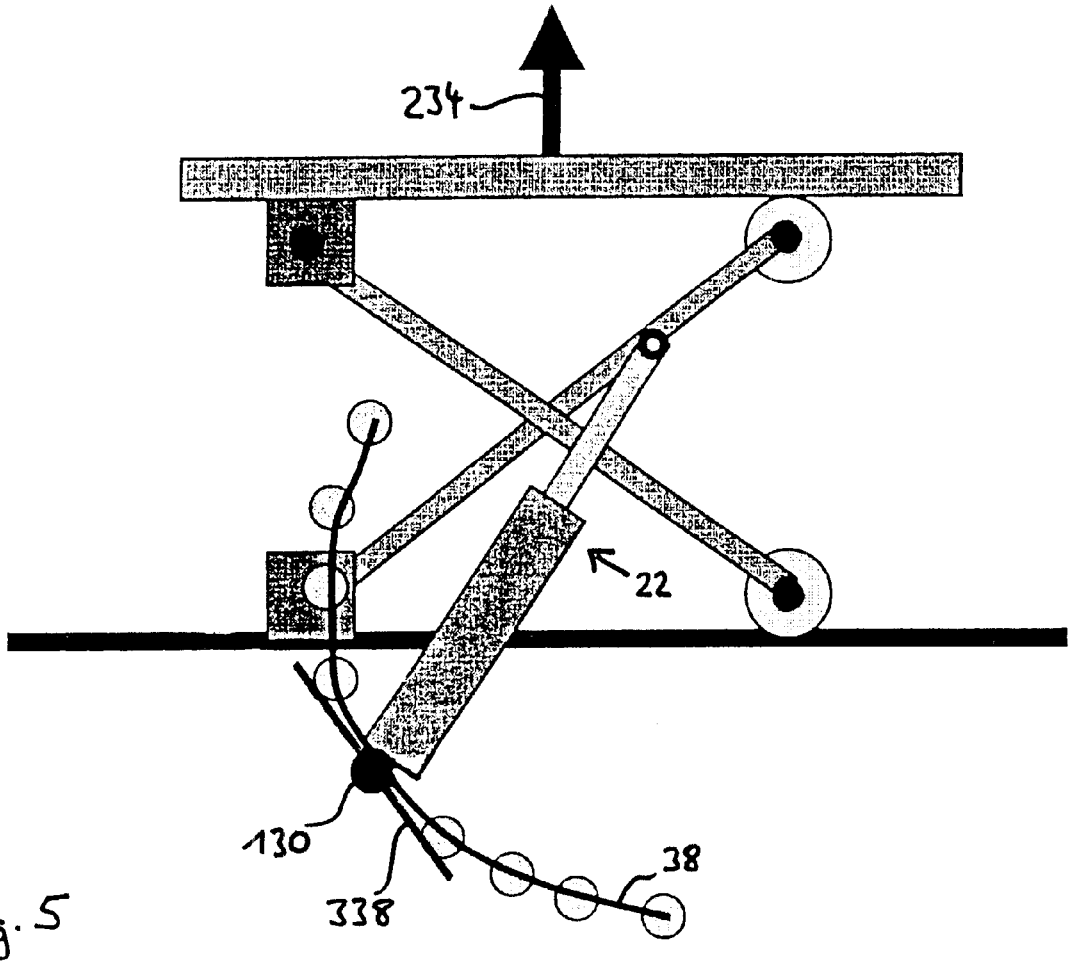
FIG. 5 shows a schematic side view of the device of FIG. 3, in which the mounting point of the gas spring is movable along an approximated constant force curve.

FIG. 5 shows the lifting device of FIG. 3, in which the mounting point 130 of the gas spring 22 is movable along an approximated constant force curve 338. As explained above with reference to FIGS. 3 and 4 the constant force curves can be calculated using e.g. a computer. Adjustments to the force 234 and the lower force (similar to force 34 shown in FIG. 1) applied to the platform in its upper or lower position normally are only of small amount and therefore the second mounting point 130 of the gas spring 22 does not necessarily need to be moved all along the constant force curve 38 but perhaps only in a section of the curve 38. This section can then be approximated by an approximated constant force curve 338 which might be a straight curve or a curve of second order. The calculation of the approximated constant force curve 338 can be done using a computer, and may be a tangent line to the point 130 of curve 38.

Figure 6:
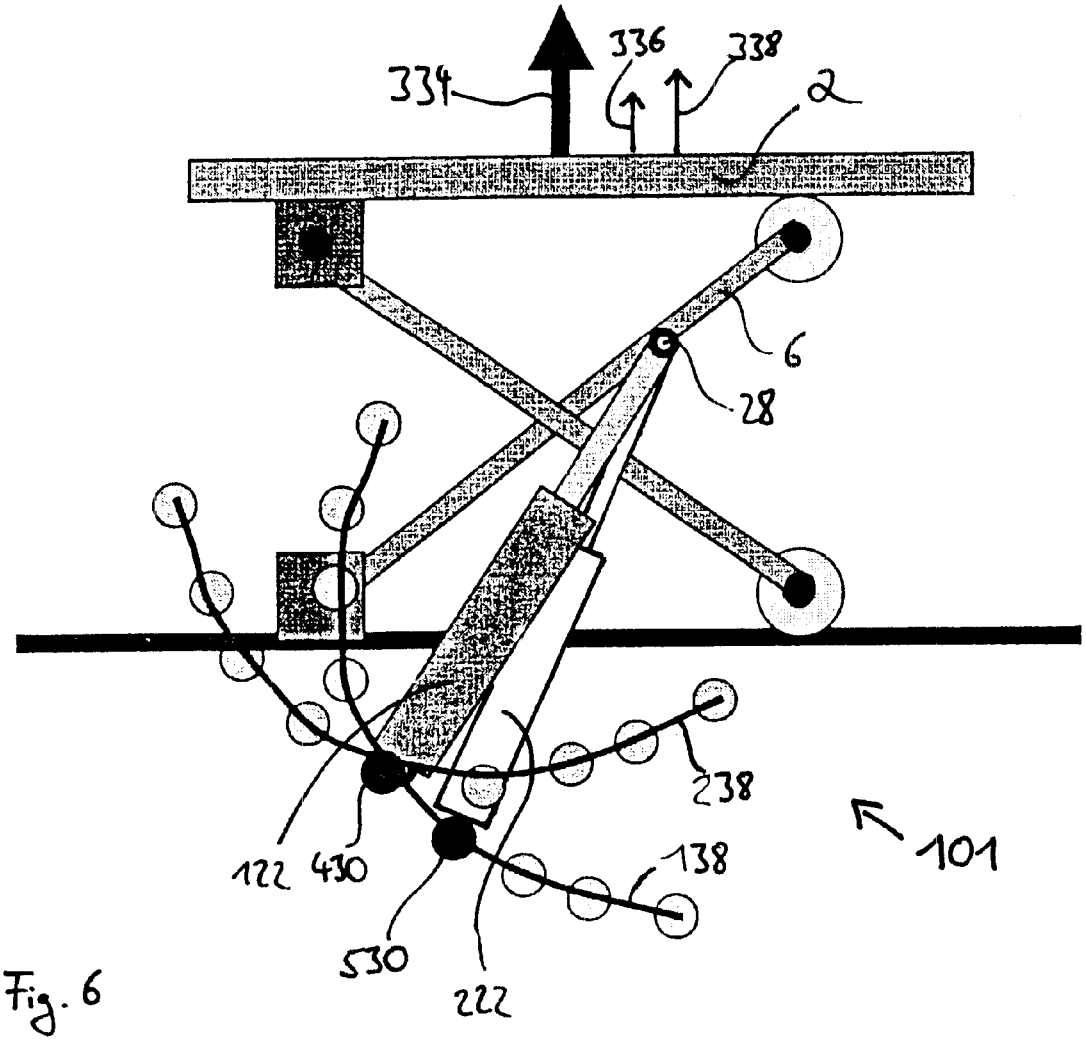
FIG. 6 shows a schematic side view of the device for independently adjusting two forces applied to a platform according to the present invention, in which the mounting points of a first and a second gas spring are movable along constant force curves.

To adjust both forces independently a device 101 as shown in FIG. 6 can be used. In addition to a first gas spring 122 a second gas spring 222 is mounted to the first scissors leg 6 at mounting point 28. The force 334 applied to the platform 2 in its upper position is the sum of the resulting first force 336 applied to the platform 2 by the first gas spring 122 and of the resulting third force 338 applied to the platform 2 by the second gas spring 222. In order to adjust the force 334, the second mounting point 430 of the first gas spring 122 can be moved along second constant force curve 238. This movement results in a change of the first force 336 which subsequently results in a change of the force 334. Both gas springs 122 and 222 also apply a respective force to the platform 2 when the platform 2 is in the lower position which two forces can be summed up to a resulting force. In order to change this resulting force the fourth mounting point 530 of the second gas spring 222 can be moved along the first constant force curve 138 which movement results in change of the forth force applied to the platform 2 in its lower position whereas the third force 338 remains constant.

Therefore, the use of two gas springs 122 and 222 having respective mounting points 430 and 530 which are movable along respective constant force curves 138 and 238 for the upper and lower position of the platform 2 allow for independent adjustment or regulation of the forces applied to the platform 2 in its upper and lower position.

The use of the device 101 as shown in FIG. 6 to lift a platform 2 allows for independent adjustment or regulation of the forces 34 and 134 as shown in FIGS. 1 and 2, so that force 134 may be less, equal or greater than force 34.

Figure 7:
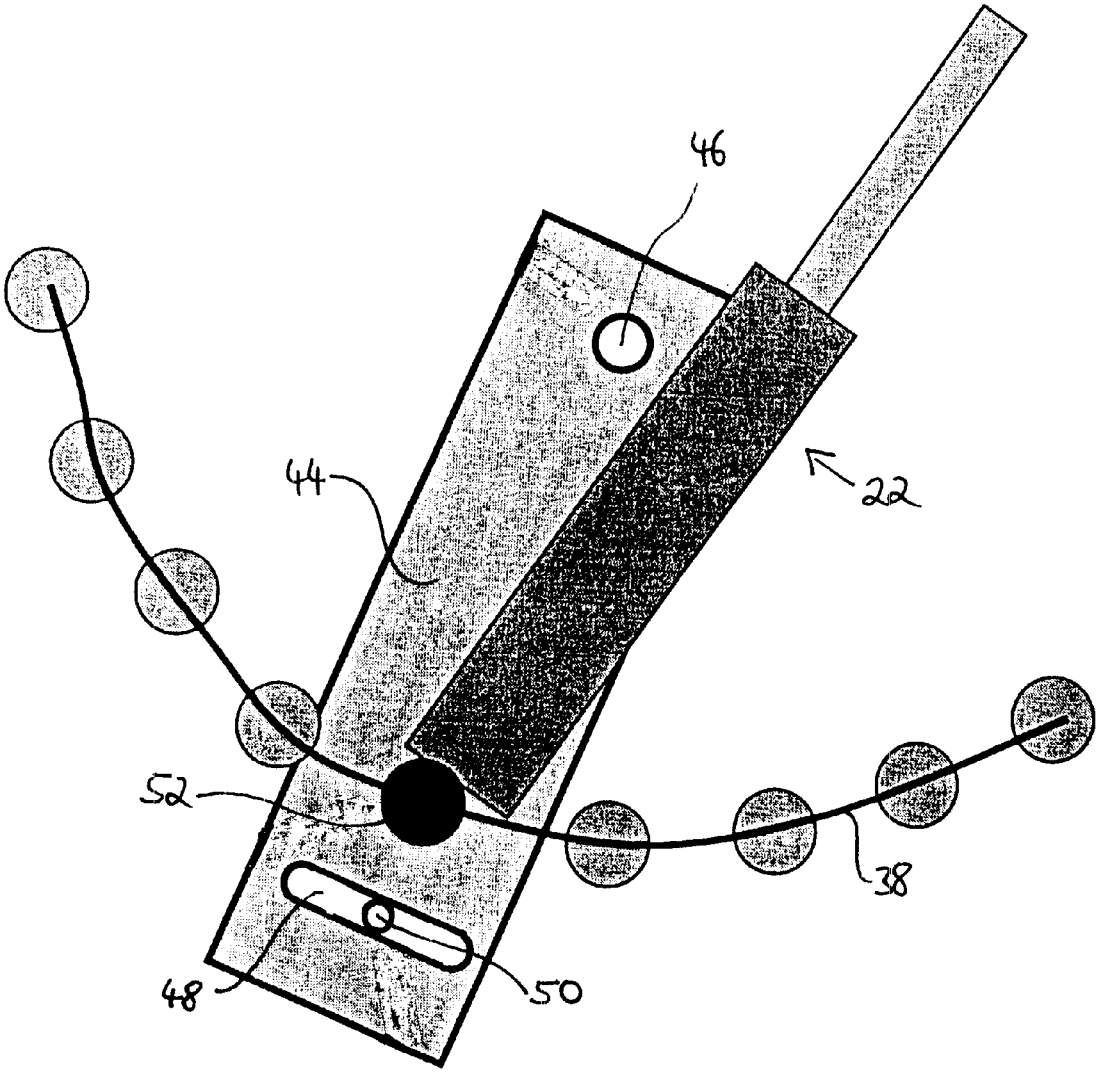
FIG. 7 shows a detailed schematic side view of a mounting point of the gas spring, in which the mounting point includes a mounting plate.

FIG. 7 shows a mounting plate 44 which is mounted to the base or a base element at a pivot point 46. The mounting plate 44 includes a slot 48 and the base 16 includes a pin 50 which in cooperation limit the possible movement of the mounting plate 44. The gas spring 22 is pivotally mounted to the mounting plate at cylinder mounting point 52. A rotation of the mounting plate 44 around pivot point 46 occurs within the limits given by the slot 48 and the pin 50 and moves the cylinder mounting point 52 along constant force curve 38.

Figure 8:
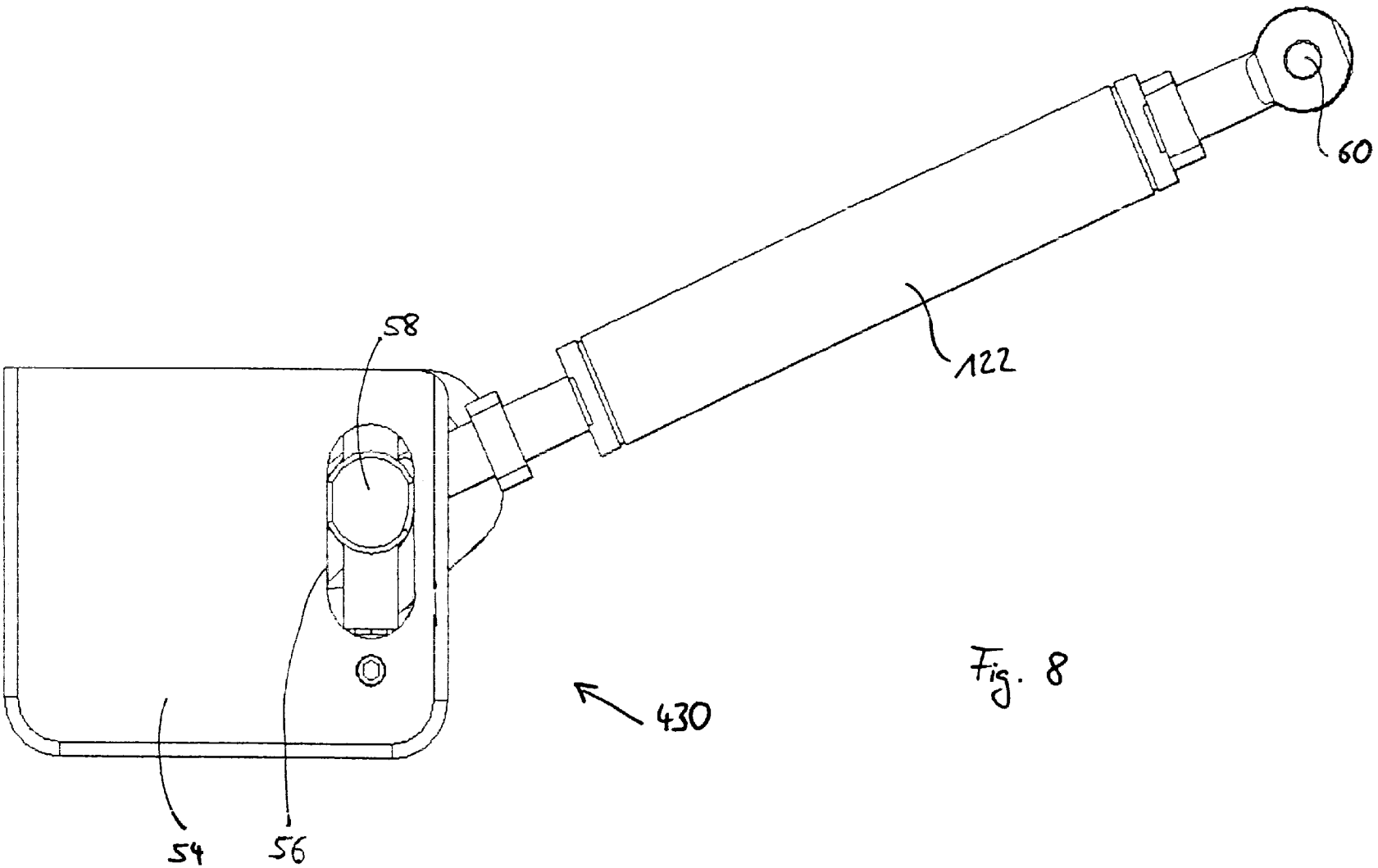
FIG. 8 shows a detailed schematic side view of a mounting point of the first gas spring, in which the constant force curve is approximated.

FIG. 8 shows the first gas spring 122 having a mounting point 430 which includes a plate 54. The plate 54 has a slot 56 which approximates a constant force curve and in which a mounting element 58 is movable. The movement of the mounting element 58 along the approximated constant force curve defined by the slot 56 changes the angle between the gas spring 122 and a scissors leg to which the gas spring 122 is mounted at mounting point 60 and simultaneously changes the compression of the gas spring 122. Therefore, the resulting force applied the a movable element in a first position remains constant as the resulting force applied to the same movable element in a second position is adjusted.

Figure 9:
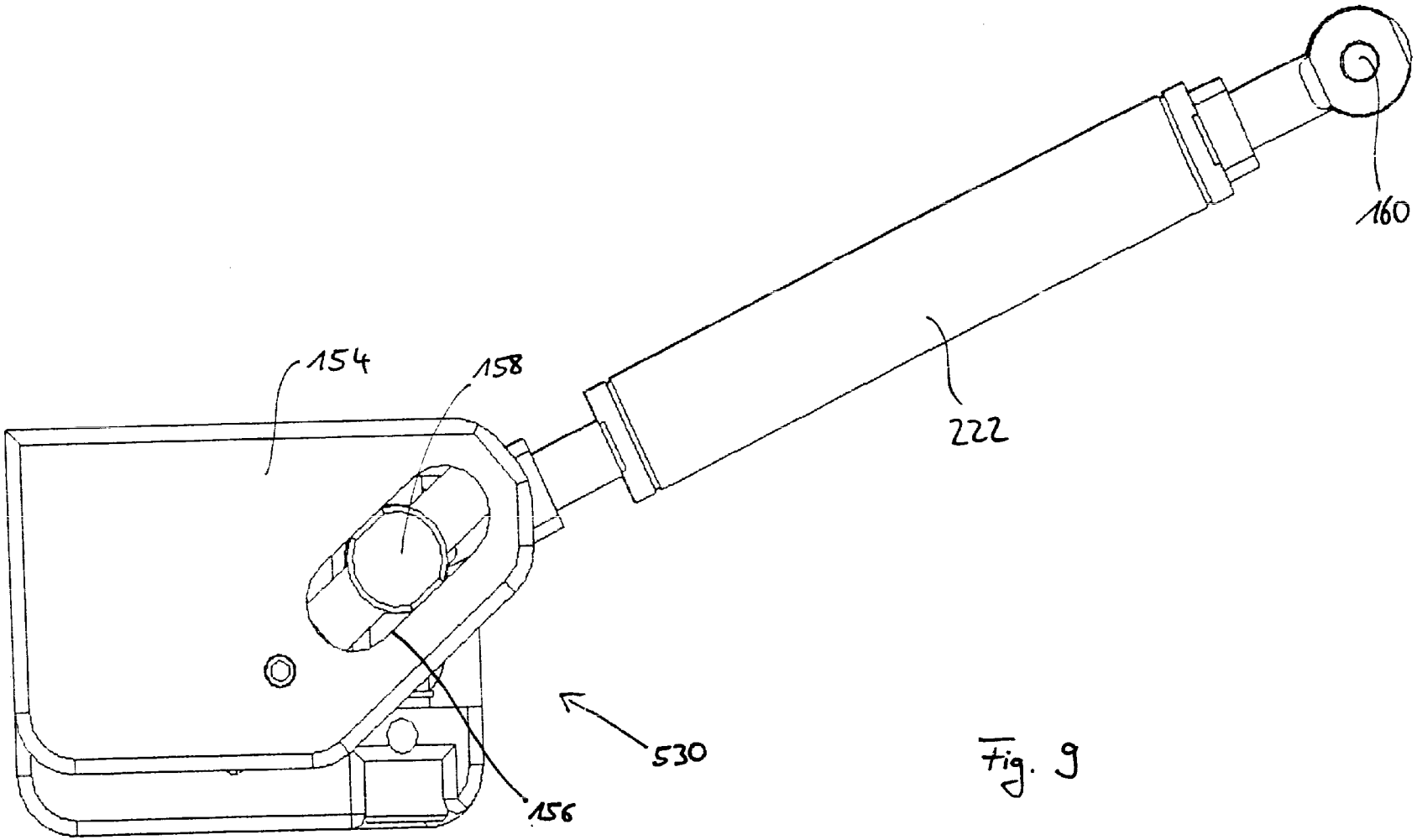
FIG. 9 shows a detailed schematic side view of a mounting point of the second gas spring, in which the constant force curve is approximated.

FIG. 9 shows the second gas spring 222 having a mounting point 530. A slot 156 in a plate 154 approximates a constant force curve so that the movement of a mounting element 158 within the limits of the slot 156 does not change the force applied to the movable in the second position of the movable element but adjusts the force applied to the movable element in the first position to which the second gas spring 222 is mounted at mounting point 160.

The two mechanisms shown in FIGS. 8 and 9 can be used to adjust the forces applied to the same movable element, e.g. the platform 6 shown in FIG. 6, in a first and a second position of the movable element independently.

The term "curve" in this application has the meaning of a curve with any shape, e.g. a straight curve.

"Constant force curve" as defined herein includes actual approximated constant force curves, and may include a straight line.

For example by following the exact curve a movement of the mounting point of 10 mm results in a change in a first force of 20.1 lbs whereas the resulting change in a second force is 0 lbs. Further, by following a straight line, which represents the approximated curve, movement of the mounting point of 10 mm results in a change in the first force of 20.8 lbs whereas the resulting change in the second force is 0.9 lbs.

In this case the deviation of the straight line from the exact curve is about 4%, the percentage being defined as X/L, where L is half the length of the straight line and X is the distance of an end point of the straight line from the exact curve.

In general, the acceptable deviation from the ideal curve could be much more than 4%, e.g. when a weaker gas spring is used, preferably less than 25%.

The change in force 2 in the straight line adjustment is only about 5% of the change in force 1. Therefore, an operator can use the device with the straight line slot to make small changes in force 1 because the corresponding change in force 2 is only 5% and likely not to be noticed in practice. In this case the straight line can successfully substitute the exact curve.

The term "mounting point" in this application does also comprise means for mounting a force applying device to a base element, e.g. a mounting plate, a mounting element, a pin or a slot.

The terms "base" and "base element" in this application do not only mean a separate element to which e.g. a gas spring can be mounted but also mean a machine, a printing press, a folder, the structure or frames of such a machine, printing press or folder, operation decks or platforms.

What is claimed is:

1. A method for adjusting a first force applied to a movable element in a first position of the movable element by a force applying device, the force applying device applying a second force to the movable element in a second position of the movable element, comprising the steps of:

connecting the movable element and a base element with a scissors-type linkage;

mounting the force applying device to the scissors-type linkage at a first mounting point;

mounting the force applying device to the base element at a second mounting point; and moving at least one of the first and the second mounting points along a constant force curve, so that the second force remains constant as the first force is adjusted.

2. The method as recited in claim 1, further comprising the steps of:

providing a further force applying device, the further force applying device applying a third force to the movable element in the first position of the movable element and the further force applying device applying a fourth force to the movable element in the second position of the movable element;

mounting the further force applying device to the scissors-type linkage at a third mounting point;

mounting the further force applying device to the base element at a fourth mounting point;

adjusting the fourth force applied to a movable element in the second position of the movable element by moving at least one of the third and the fourth mounting points along a constant force curve, so that the third force remains constant as the fourth force is adjusted.

3. The method as recited in claim 2, wherein the moving of at least one of the first, the second, the third and the fourth mounting point is along an approximated constant force curve.

4. The method for independently adjusting a first and a fourth force applied to a platform, comprising the steps of:

connecting the platform and a base element with a scissors-type linkage;

mounting a first gas spring to the scissors-type linkage at a first mounting point and mounting the first gas spring to the base element at a second mounting point;

mounting a second gas spring to the scissors-type linkage at a third mounting point and mounting the second gas spring to the base element at a fourth mounting point;

applying the first force to the platform in an upper position and applying a second force to the platform in a lower position using the first gas spring;

applying a third force to the platform in the upper position and applying the fourth force to the platform in the lower position using the second gas spring;

moving at least one of the first and the second mounting points along a constant force curve, so that the second force remains constant as the first force is adjusted; and moving at least one of the third and the fourth mounting points along a constant force curve, so that the third force remains constant as the fourth force is adjusted.

5. A device for adjusting a first force applied to a movable element, comprising:

a movable element;

a base element;

a scissors-type linkage, the scissors-type linkage connecting the base element and the movable element; and a force applying device applying a first force to the movable element in a first position of the movable element and applying a second force to the movable element in a second position of the movable element;

the force applying device being mounted to the scissors-type linkage at a first mounting point and being mounted to the base element at a second mounting point, at least one of the first and second mounting points being movable along a constant force curve, so that the second force remains constant as the first force is adjusted.

6. The device as recited in claim 5, wherein the movable element is a platform, the first position is an upper position and the second position is a lower position.

7. The device as recited in claim 6, wherein the platform is a liftable working platform of a printing press and the base element is part of an operation deck of the printing press.

8. The device as recited in claim 5, wherein the scissors-type linkage includes at least two pairs of scissors legs, each scissors leg being connect at one end to one of the platform and the base element.

9. The device as recited in claim 5, wherein the force applying device is one of a gas spring, a coil spring, an air cylinder, a pneumatic cylinder or a hydraulic cylinder.

10. The device as recited in claim 5, further comprising means for moving one of the first and second mounting points along the constant force curve.

11. The device as recited in claim 10, wherein the means for moving one of the first and second mounting points include a mounting element movable along a curved slot.

12. The device as recited in claim 11, wherein the curved slot corresponds to the constant second force curve.

13. The device as recited in claim 12, wherein the curved slot is a straight slot.

14. The device as recited in claim 10, wherein the second mounting point including a mounting plate pivotally mounted to the base element and having a slot with two ends for receiving a pin, the two ends and the pin limiting the pivotal movement of the mounting plate; and the force applying device being pivotally mounted to the mounting plate.

15. The device as recited in claim 5, further comprising:

a further force applying device, the further force applying device applying a third force to the movable element in the first position of the movable element and the further force applying device applying a fourth force to the movable element in the second position of the movable element;

the further force applying device being mounted to the scissors-type linkage at a third mounting point and being mounted to the base element at a fourth mounting point, at least one of the third and fourth mounting points being movable along a constant force curve, so that the third force remains constant as the fourth force is adjusted.

16. A device for adjusting a first force applied to a movable platform of a printing press, comprising:

a base element being part of an operation deck of the printing press;

a scissors-type linkage, the scissors-type linkage connecting the base element and the movable platform, the scissors-type Linkage including at least two pairs of scissors legs; and a gas spring applying the first force to the movable platform in an upper position of the movable platform and applying a second force to the movable platform in a lower position of the movable platform;

the gas spring being mounted to the scissors-type linkage at a first mounting point and being mounted to the base element at a second mounting point, the second mounting point being movable along a constant force curve, so that the second force remains constant as the first force is adjusted.

17. A printing press comprising a device for adjusting a first force applied to a movable element, the device including:

a movable element;

a base element;

a scissors-type linkage, the scissors-type linkage connecting the base element and the movable element; and a force applying device applying a first force to the movable element in a first position of the movable element and applying a second force to the movable element in a second position of the movable element;

the force applying device being mounted to the scissors-type linkage at a first mounting point and being mounted to the base element at a second mounting point, at least one of the first and second mounting points being movable alone a constant force curve, so tat the second force remains constant as the first force is adjusted.

18. A printing press comprising a device as recited in claim 16.

* * * * *